US008280268B2

(12) United States Patent
Imura et al.

(10) Patent No.: US 8,280,268 B2
(45) Date of Patent: Oct. 2, 2012

(54) DEVELOPING DEVICE, AND CONTROLLING METHOD THEREOF

(75) Inventors: Tomoyuki Imura, Toyohashi (JP); Kazuhiro Saito, Toyokawa (JP); Takuya Okada, Toyokawa (JP); Takuya Sasaki, Toyokawa (JP); Chikara Tsutsui, Nishinomiya (JP); Takayuki Takai, Anjou (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 87 days.

(21) Appl. No.: 12/876,488

(22) Filed: Sep. 7, 2010

(65) Prior Publication Data

US 2011/0058835 A1 Mar. 10, 2011

(30) Foreign Application Priority Data

Sep. 7, 2009 (JP) ..... 2009-205699

(51) Int. Cl.
*G03G 15/06* (2006.01)
*G03G 15/08* (2006.01)
*G03G 15/09* (2006.01)

(52) U.S. Cl. ..... 399/55; 399/270; 399/285

(58) Field of Classification Search ..... 399/55
See application file for complete search history.

(56) References Cited

U.S. PATENT DOCUMENTS 4,885,223 A 12/1989 Enoki et al.
5,617,190 A * 4/1997 Takenaka et al. ..... 399/159
5,625,441 A * 4/1997 Sugiyama et al. ..... 399/272
5,832,350 A * 11/1998 Kumasaka et al. ..... 399/282
7,917,046 B2 * 3/2011 Kubo ..... 399/44
2003/0185598 A1 * 10/2003 Folkins et al. ..... 399/266
2004/0022549 A1 2/2004 Ozawa et al.
2004/0101324 A1 * 5/2004 Kawano ..... 399/55
2005/0158061 A1 * 7/2005 Do ..... 399/44
2006/0222415 A1 * 10/2006 Hirobe ..... 399/265

(Continued)

FOREIGN PATENT DOCUMENTS

JP 63-103279 A 5/1988

(Continued)

OTHER PUBLICATIONS

Decision to Grant a Patent Issued on Aug. 9, 2011 by the Japanese Patent Office in corresponding Japanese Patent Application No. 2009-205699, and English language translation of the Decision.

*Primary Examiner* — Walter L Lindsay, Jr.
*Assistant Examiner* — David Bolduc
(74) *Attorney, Agent, or Firm* — Buchanan Ingersoll & Rooney PC

(57) ABSTRACT

A developing device is provided with a first transporting member for transporting a developer containing a toner and a carrier; a second transporting member opposite to the first transporting member to interpose a first spatial region therebetween and opposite to an electrostatic latent image carrying member to interpose a second spatial region therebetween; a first electric field forming device, composed of first and second power sources, for shifting the toner in the developer held onto the first transporting member to the second transporting member; and a second electric field forming device, composed of the second power source, for shifting the toner held onto the second transporting member to an electrostatic latent image on the carrying member. The operation of the second electric field forming device is controlled based on electric currents flowing in the first and second power sources, which are detected by first and second detecting blocks, respectively.

8 Claims, 8 Drawing Sheets

U.S. PATENT DOCUMENTS

| | | | | |
|---|---|---|---|---|
| 2008/0181675 | A1* | 7/2008 | Fujishima et al. | 399/267 |
| 2008/0206661 | A1* | 8/2008 | Fujishima et al. | 430/48 |
| 2008/0226350 | A1* | 9/2008 | Goto et al. | 399/240 |
| 2008/0232859 | A1* | 9/2008 | Sakata et al. | 399/270 |
| 2008/0232860 | A1* | 9/2008 | Sakata et al. | 399/270 |
| 2008/0232862 | A1* | 9/2008 | Fujishima et al. | 399/285 |
| 2008/0292365 | A1* | 11/2008 | Fujishima et al. | 399/285 |
| 2009/0003891 | A1* | 1/2009 | Fujishima et al. | 399/284 |
| 2009/0067890 | A1* | 3/2009 | Maeyama et al. | 399/273 |
| 2009/0245886 | A1* | 10/2009 | Sakata | 399/270 |
| 2011/0058835 | A1 | 3/2011 | Imura et al. | |

FOREIGN PATENT DOCUMENTS

| | | | |
|---|---|---|---|
| JP | 6-214451 | A | 8/1994 |
| JP | 2003-287952 | A | 10/2003 |
| JP | 2005-078015 | A | 3/2005 |
| JP | 2005-316083 | A | 11/2005 |
| JP | 2007-163602 | A | 6/2007 |
| JP | 2008-287036 | A | 11/2008 |
| JP | 2009-008959 | A | 1/2009 |
| JP | 2009-086009 | A | 4/2009 |
| JP | 2011-059162 | A | 3/2011 |

* cited by examiner $$\text{PLUS DUTY RATIO} = \frac{t1}{t1+t2} \times 100\ [\%]$$

DEVELOPING DEVICE, AND CONTROLLING METHOD THEREOF

CROSS-REFERENCE TO RELATED APPLICATION

This application is based on Japanese Patent Application No. 2009-205699 filed in Japan, the content of which is incorporated herein by reference.

BACKGROUND OF THE INVENTION

1. Field of the Invention

The present invention relates to a developing device used in an image forming apparatus in an electrophotographic manner, such as a copying machine, a printer, a facsimile, or a multifunctional machine wherein two or more thereof are combined with each other; and a controlling method thereof.

2. Description of the Related Art

Regarding image forming apparatuses in an electrophotographic manner, hitherto, as a developing manner of developing an electrostatic latent image formed on an electrostatic latent image carrying member, the following have been known: a one-Component developing manner in which only a toner is used as a main component of a developer (or developing agent), and a two-component developing manner in which a toner and a carrier are used as main components of a developer.

According to the one-component developing manner, generally, a toner is passed through a regulating region between a developing roller and a regulating plate arranged to be pushed onto the developing roller, thereby making it possible to cause the toner to undergo frictional electrification and further cause a toner thin layer having a desired thickness to be held onto the outer circumferential surface of the developing roller; therefore, this manner is advantageous for making the structure of the developing device used in the manner simple and small in size, and decreasing costs. However, in the one-component developing manner, the toner receives intense stress in the regulating region so that a deterioration in the toner is promoted. Thus, the charge amount of the toner is easily lowered with the passage of time. Moreover, the surface of the regulating plate or the surface of the developing roller is contaminated by the toner or some other external additive, so that the performance of giving electric charges onto the toner lowers. Thus, fogging or other problems are caused. As a result, the lifespan of the developing device becomes relatively short.

Additionally, in the one-component developing manner, the gap length of a developing spatial region formed between the developing roller and an electrostatic latent image carrying member opposite to this roller is varied with the passage of time so that density unevenness may be generated in obtained images. Against this, for example, Japanese Unexamined Patent Publication No. 2005-78015 discloses that in the one-component developing manner, the direct voltage value or alternating voltage value of a developing bias voltage to be applied is controlled on the basis of a value measured by an impedance measuring device for measuring an impedance of a developing spatial region and a result detected by a leakage detecting device for detecting a leakage through a leakage current flowing in the developing spatial region, whereby unevenness in the density of images is restrained.

In the meantime, according to the two-component developing manner, a toner is electrified by frictional contact between the toner and a carrier for the toner, the contact being made by mixing and stirring of the two components. Thus, stress that the toner receives is small. This matter is advantageous against a deterioration in the toner. The carrier as a material for giving electric charges to the toner is larger in surface area than particles of the toner; therefore, the carrier is relatively strong against contamination with the toner or other external additives. This is advantageous for making the lifespan of the developer longer. However, in the two-component developing manner also, the carrier is gradually contaminated with the toner or the other external additives after the developer is used over a long term. As a result, the charge amount of the toner falls so that fogging or other problems may be caused.

As a developing manner for overcoming the fall in the toner charge amount, the fogging, and other problems in the one-component and two-component developing manners, the so-called hybrid developing manner is suggested, the manner including: preparing a two-component developer composed of a toner and a carrier; electrifying the toner by frictional contact between the toner and the carrier; holding this developer made into a magnetic brush state on a transporting roller including therein a magnetic pole body while transporting the developer into a region opposite to a developing roller by the rotation of the transporting roller; supplying the developing roller with only the toner from the developer held onto the transporting roller by the effect of an electric field formed in this region, thereby forming a toner layer on the developing roller; transporting this toner layer to a region opposite to an electrostatic latent image carrying member by the rotation of the developing roller; and making use of the effect of an electric field formed in this opposite region to fly the toner held onto the developing roller onto an electrostatic latent image formed on the electrostatic latent image carrying member, thereby developing the latent image.

According to the hybrid developing manner, the electrification of the toner is attained by the frictional contact between the components of the two-component developer; thus, a deterioration in the toner is restrained, and a sufficient toner charge amount can be certainly kept. Moreover, the supply of the toner from the transporting roller to the developing roller is attained by the electric field; thus, no toner electrified into a reverse polarity is supplied to the developing roller. Accordingly, no toner adheres onto a non-image area on the electrostatic latent image carrying member, so that the generation of fogging is prevented. The adhesion of the carrier onto the electrostatic latent image carrying member is also prevented since only the toner is supplied to the developing roller.

However, in a developing device in the hybrid developing manner also, density unevenness may be generated in an obtained image when the gap length of a developing spatial region is varied, the region being formed between a developing roller and an electrostatic latent image carrying member of the device. When the gap length of the developing spatial region is larger than a predetermined value, the amount of the toner shifted from the developing roller to the electrostatic latent image carrying member is small. When the gap length of the developing spatial region is smaller than the predetermined value, the amount of the toner shifted from the developing roller to the electrostatic latent image carrying member is large. Thus, in a toner image obtained by making the electrostatic latent image formed on the electrostatic latent image carrying member visible, density unevenness caused by a variation in the gap length of the developing spatial region may be generated.

SUMMARY OF THE INVENTION

Thus, a basic object of the invention is to provide a developing device, in a hybrid developing manner using a two-component developer containing a toner and a carrier, in which even when the gap length of a developing spatial region is varied, density unevenness caused by the variation in the gap length of the developing spatial region is restrained, so that a stable development can be attained.

In order to achieve the above object, the invention provides a developing device, including: a first transporting member that is rotatably driven, and holds, on an outer circumferential surface, a developer containing a toner and a carrier while the developer is transported, a second transporting member that is rotatably driven, and is opposite to the first transporting member to interpose a first spatial region between the members, and is opposite to an electrostatic latent image carrying member to interpose a second spatial region between the second transporting member and the carrying member, a first electric field forming device that includes a first power source connected to the first transporting member and a second power source connected to the second transporting member, forms a first electric field between the first and second transporting members, and shifts the toner in the developer held onto the first transporting member to the second transporting member, and a second electric field forming device that includes the second power source connected to the second transporting member, forms a second electric field between the second transporting member and the electrostatic latent image carrying member, and shifts the toner held onto the second transporting member to an electrostatic latent image of the electrostatic latent image carrying member, thereby converting the electrostatic latent image to a visible image, the developing device further including: a first detecting block that detects a current flowing in the first power source, a second detecting block that detects a current flowing in the second power source, and an electric field controlling device that controls operation of the second electric field forming device based on the current flowing in the first power source, which is detected by the first detecting block, and the current flowing in the second power source, which is detected by the second detecting block.

Moreover, the invention provides a method for controlling a developing device including a first transporting member that is rotatably driven, and holds, on an outer circumferential surface, a developer containing a toner and a carrier while the developer is transported, a second transporting member that is rotatably driven, and is opposite to the first transporting member to interpose a first spatial region between the members, and is opposite to an electrostatic latent image carrying member to interpose a second spatial region between the second transporting member and the carrying member, a first electric field forming device that includes a first power source connected to the first transporting member and a second power source connected to the second transporting member, forms a first electric field between the first and second transporting members, and shifts the toner in the developer held onto the first transporting member to the second transporting member, and a second electric field forming device that includes the second power source connected to the second transporting member, forms a second electric field between the second transporting member and the electrostatic latent image carrying member, and shifts the toner held onto the second transporting member to an electrostatic latent image of the electrostatic latent image carrying member, thereby converting the electrostatic latent image to a visible image, the method including: detecting a current flowing in the first power source and a current flowing in the second power source, and controlling, based on the detected current flowing in the first power source and the detected current flowing in the second power source, operation of the second electric field forming device.

DESCRIPTION OF THE PREFERRED EMBODIMENTS

With reference to the attached drawings, preferred embodiments of the invention will be described hereinafter. In the description, the words "upper, over, above or on", "lower, under, below or beneath", "left" and "right", any wording including one or more of these words, the word "clockwise", the word "counterclockwise", and words or wordings each meaning a specified side or direction may be used; however, the use thereof is for making the understanding of the invention described with reference to the drawings easy, and the invention should not be interpreted to be restricted by the meanings of these words.

Figure 1:
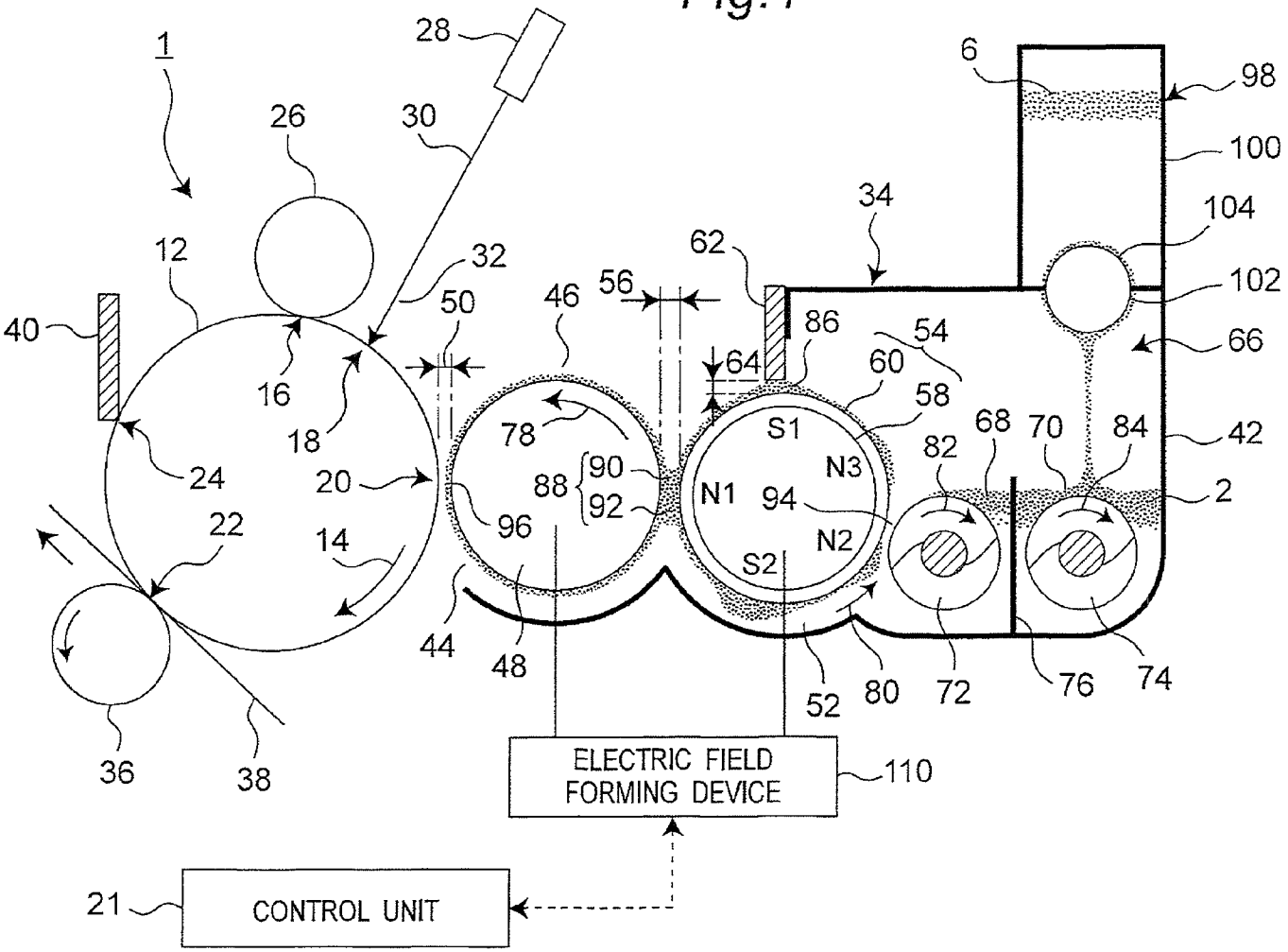
FIG. 1 is a view illustrating a schematic structure of an image forming apparatus according to an embodiment of the invention.

FIG. 1 is a view illustrating a schematic structure of an image forming apparatus according to an embodiment of the invention. The image forming apparatus may be any one of a copying machine, a printer, a facsimile, and a multifunctional apparatus having two or more of functions of these machines or apparatus. An image forming apparatus 1 has a photoreceptor 12 as an electrostatic latent image carrying member on which an electrostatic latent image is to be carried. The photoreceptor 12 is in a barrel form. However, in the invention, the photoreceptor 12 is not limited to such a form. Thus, instead of the photoreceptor in the barrel form, a photoreceptor in an endless belt form may be used. The photoreceptor 12 is drivably connected to a motor not illustrated, and is rotatable in a direction represented by an arrow 14 on the basis of the driving of the motor. Around the photoreceptor 12, the following are successively arranged along the rotating direction of the photoreceptor 12: an electrifying (or charging) station 16, an exposing station 18, a developing station 20, a transferring station 22, and a cleaning station 24.

The electrifying station 16 has an electrifier 26 for electrifying a photoreceptor layer, which constitutes the outer circumferential surface of the photoreceptor 12, into a predetermined potential. The electrifier 26 is illustrated as a cylindrical roller; however, instead of this, an electrifier in any other form may be used, examples thereof including a rotary type or fixed type electrifier in a brush form, and an electrifier in a wire discharge manner. The exposing station 18 has a passage 32 for causing an image light ray 30, which is emitted from an exposing device 28 arranged near the photoreceptor 12 or apart from the photoreceptor 12, to advance onto the outer circumferential surface of the photoreceptor 12 electrified by the electrifier 26. An electrostatic latent image is formed on the outer circumferential surface of the photoreceptor 12 that has passed through the exposing station 18. The latent image is composed of a region where the image light ray is projected so that the potential is attenuated, and a region where the electrification potential is substantially maintained. In the present embodiment, the region where the potential is attenuated is an electrostatic latent image region, and the region where the electrification potential is substantially maintained is a non-electrostatic latent image region. The developing station 20 has a developing device 34 for visualizing the electrostatic latent image by the use of a powdery developer. Details of the developing device 34 will be described later. The transferring station 22 has a transferring device 36 for transferring the visualized image formed on the outer circumferential surface of the photoreceptor 12 onto a sheet 38 as a recording medium 38. Although the transferring device 36 is illustrated as a cylindrical roller, a transferring device in any other form, such as a transferring device in a wire discharge manner, may be used. The cleaning station 24 has a cleaning device 40 for collecting, from the outer circumferential surface of the photoreceptor 12, a non-transferred fraction of the developer that remains on the outer circumferential surface of the photoreceptor 12 without being transferred onto the sheet 38 in the transferring station 22. The cleaning device 40 is shown as a plate-form blade; however, instead of this, a cleaning device in any other form, such as a rotary or fixed type cleaning device in a brush form, may be used.

When an image is formed in the image forming apparatus 1 having this structure, the photoreceptor 12 is clockwise rotated by the driving of the motor. At this time, an outer circumferential region of the photoreceptor 12 that passes through the electrifying station 16 is electrified into a predetermined potential by the electrifier 26. The electrified outer circumferential region of the photoreceptor 12 is exposed to the image light ray 30 in the exposing station 18, so that an electrostatic latent image is formed. The electrostatic latent image is transported into the developing station 20 to the accompaniment of the rotation of the photoreceptor 12, and visualized as a developer image in the station 20 by the developing device 34. The visible developer image is transported to the transferring station 22 to the accompaniment of the rotation of the photoreceptor 12, and transferred onto the sheet 38 in the station 22 by the transferring device 36. The sheet 38 on which the developer image is transferred is transported to a fixing station not illustrated, and the developer image is fixed onto the sheet 38 in the station. The outer circumferential region of the photoreceptor 12 that has passed through the transferring station 22 is transported to the cleaning station 24, and then the fraction of the developer that remains on the outer circumferential surface of the photoreceptor 12, without being transferred onto the sheet 38, is collected in the station 24.

The developing device 34 holds a two-component developer containing a nonmagnetic toner, which is made of first component particles, and a magnetic carrier, which is made of second component particles, and has a housing 42 holding various members that will be described below. In order to make the understanding of the invention easy by making FIG. 1 simple, the illustration of the housing 42 is partially deleted. In the developer used in the embodiment, the toner is electrified into negative polarity and the carrier is electrified into positive polarity by frictional contact of the two components with each other. However, the electrification properties (or charging characteristics) of the toner and the carrier used in the invention are not limited to those specified by the combination. Alternatively, the toner may be electrified into positive polarity and the carrier may be electrified into negative polarity by frictional contact of the two components with each other.

The housing 42 of the developing device 34 has an opening 44 made open toward the photoreceptor 12. In a space 46 formed near the opening 44 is arranged a developing roller 48 as a toner transporting member (second transporting member). The developing roller 48 is a cylindrical member, and is rotatably arranged in parallel to the photoreceptor 12 to interpose a predetermined developing gap 50 between the roller 48 and the outer circumferential surface of the photoreceptor 12.

The developing roller 48 may be, for example, a conductive roller made of aluminum or some other metal, or a roller having an outer circumferential surface, which is the outermost layer region of the conductive roller, provided with a coating. The coating may be, for example, made of a resin such as polyester resin, polycarbonate resin, acrylic resin, polyethylene resin, polypropylene resin, urethane resin, polyamide resin, polyimide resin, polysulfone resin, polyetherketone resin, vinyl chloride resin, vinyl acetate resin, silicone resin or a fluorine-contained resin, or a coating made of a rubber such as silicone rubber, urethane rubber, nitrile rubber, natural rubber or isoprene rubber. However, the coating is not limited thereto. A conductant (or electric conductant) may be added into the coating or onto the surface of the coating. The conductant may be an electron conductant or an ion conductant. Examples of the electron conductant include ketjen black, acetylene black, furnace black, and other carbon black particles; metallic powder; and metal oxide particles. However, the electron conductant is not limited thereto. Examples of the ion conductant include cationic compounds such as quaternary ammonium salts; amphoteric compounds; and other ionic polymer materials. However, the ion conductant is not limited thereto.

In the rear of the developing roller 48, another space 52 is formed. In the space 52, a transporting roller 54, which is a developer transporting member (first transporting member), is arranged in parallel to the developing roller 48 to interpose a predetermined supplying/collecting gap 56 between the roller 54 and the outer circumferential surface of the developing roller 48. The transporting roller 54 has a magnet unit 58 fixed not to be rotatable, and a cylindrical sleeve 60 supported to be rotatable around the magnet unit 58. Over the sleeve 60, a regulating plate 62, which is fixed to the housing 42 and is extended in parallel to the central axis of the sleeve 60, is arranged to interpose a predetermined regulating gap 64 between the plate 62 and the sleeve 60.

The magnet unit 58 has plural magnetic poles that are opposite to the inner surface of the sleeve 60 and are extended toward the central axis of the transporting roller 54. In the embodiment, the magnetic poles include a magnetic pole S1 opposite to an upper inner circumferential region of the sleeve 60 near the regulating plate 62, a magnetic pole N1 opposite to a left inner circumferential region of the sleeve 60 near the supplying/collecting gap 56, a magnetic pole S2 opposite to a lower inner circumferential region of the sleeve 60, and two adjacent magnetic poles N2 and N3 that have the same polarity and are opposite to a right inner circumferential region of the sleeve 60.

In the rear of the transporting roller 54, a developer agitating room 66 is formed. The agitating room 66 has a front room 68 formed near the transporting roller 54, and a rear room 70 apart from the transporting roller 54. In the front room 68, a front screw 72, which is a front agitating and transporting member for transporting the developer 2 from the front surface of the sheet on which FIG. 1 is drawn to the rear surface thereof while agitating the developer 2, is rotatably arranged. In the rear room 70, a rear screw 74, which is a rear agitating and transporting member for transporting the developer 2 from the rear surface of the sheet to the front surface thereof while agitating the developer 2, is rotatably arranged. As illustrated in FIG. 1, the front room 68 and the rear room 70 may be separated from each other by a partition wall 76 arranged therebetween. In this case, partition wall regions near both ends of each of the front room 68 and the rear room 70 are removed so that connection passages are formed. The developer reaching the downstream end of the front room 68 is sent through one of the connection passages to the rear room 70, and the developer reaching the downstream end of the rear room 70 is sent through the other connection passage to the front room 68.

Over the rear room 70 is arranged a toner replenishing unit 98. The toner replenishing unit 98 has a container 100 which holds a toner 6. An opening 102 is formed in the bottom of the container 100, and a replenishing roller 104 is arranged in the opening 102. The replenishing roller 109 is drivably connected to a motor not illustrated. The motor is driven by an output from a magnetic permeability sensor (not illustrated) as a measuring device for measuring the ratio (ratio by weight) of the toner 6 in the developer 2 held in the housing 42, so that the toner 6 is dropped and replenished into the rear room 70.

The transporting roller 54 and the developing roller 48 are each connected electrically to an electric field forming device 110. The electric field forming device 110 is configured in such a manner that a predetermined electric field is formed between the transporting roller 54 and the developing roller 48 as follows: inside a spatial region (supplying/collecting spatial region) 88 between the transporting roller 54 and the developing roller 48 opposite to each other, mainly in a spatial region (supplying spatial region) 90 at the upstream side of the region 88 in the rotating direction of the transporting roller 54, the toner 6 in the developer 2 held onto the transporting roller 54 is shifted to the developing roller 48; and inside the supplying/collecting spatial region 88, mainly in a spatial region (collecting spatial region) 92 at the downstream side of the region 88 in the rotating direction of the transporting roller 54, a fraction of the toner 6 that remains on the developing roller 48 after a latent image is developed is collected onto the transporting roller 54.

Figure 2:
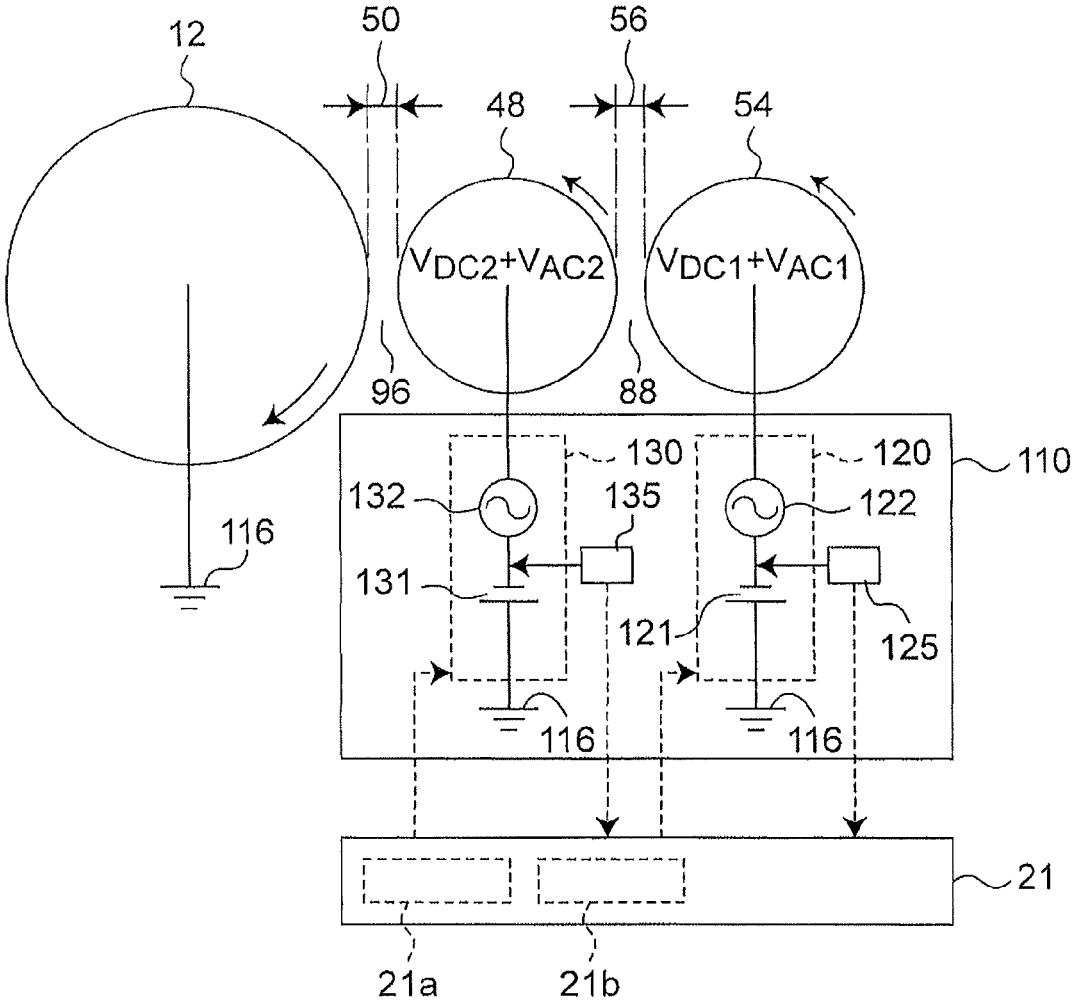
FIG. 2 is a view specifically illustrating an electric field forming device in the image forming apparatus.
Figure 3:
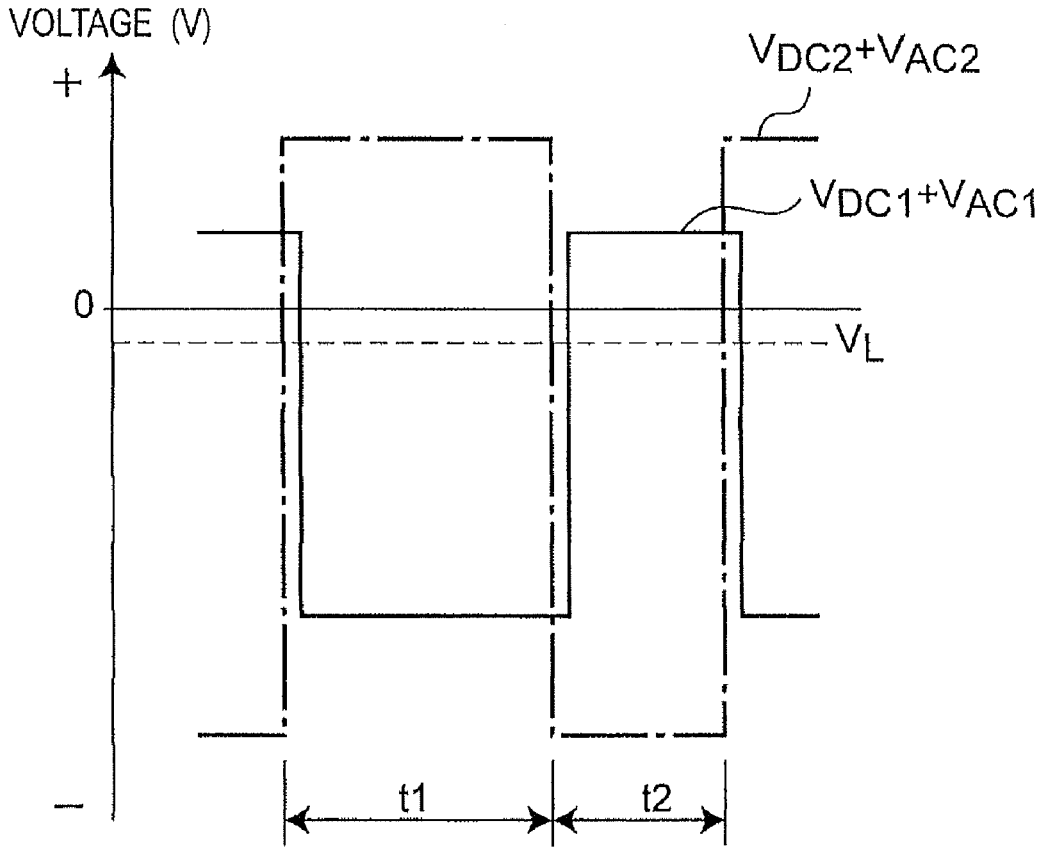
FIG. 3 is a chart showing a relationship between voltages supplied from the electric field forming device illustrated in FIG. 2 to a transporting roller and a developing roller.

FIG. 2 is a view specifically illustrating the electric field forming device 110 in the image forming apparatus 1, and FIG. 3 is a chart showing a relationship between voltages supplied from the electric field forming device 110 illustrated in FIG. 2 to the transporting roller 54 and the developing roller 48. The electric field forming device 110 illustrated in FIG. 2 has a first power source 120 connected to the transporting roller 54, and a second power source 130 connected to the developing roller 48.

The first power source 120 has a first DC power source 121 and a first AC power source 122 between the transporting roller 54 and a ground 116 so as to be connected in series to the roller 54 and the ground 116. The first DC power source 121 applies a first direct voltage $V_{DC1}$ (for example, −270 V) having a polarity identical to the electrified polarity of the toner 6 to the transporting roller 54, and the first AC power source 122 applies a first alternating voltage $V_{AC1}$ (for example, frequency: 3 kHz, amplitude $V_{P-P}$: 900 V, plus duty ratio: 40%, and minus duty ratio: 60%) to the transporting roller 54 and the ground 116 from therebetween. The second power source 130 has a second DC power source 131 and a second AC power source 132 between the developing roller 48 and the ground 116 so as to be connected in series to the roller 48 and the ground 116. The second DC power source 131 applies a second direct voltage $V_{DC2}$ (for example, −300 V) having a polarity identical to the electrified polarity of the toner 6 to the developing roller 48, and the second AC power source 132 applies a second alternating voltage $V_{AC2}$ (for example, frequency: 3 kHz, amplitude $V_{P-P}$: 1,400 V, plus duty ratio: 60%, and minus duty ratio: 40%) to the developing roller 48 and the ground 116 from therebetween. The voltage applied to the transporting roller 54 and that applied to the developing roller 48 are set to cause phases to be deviated from each other. In FIG. 3, the voltage applied to the transporting roller 54 is slightly shifted from that applied to the developing roller 48 in the time axis direction (the transverse direction) to make FIG. 3 easy to understand.

As illustrated in FIG. 3, in the case of applying to the transporting roller 54 a vibration voltage $V_{DC1}+V_{AC1}$ in a rectangular wave form obtained by superimposing the first alternating voltage $V_{AC1}$ onto the first direct voltage $V_{DC1}$ of −270 V and further applying to the developing roller 48 a vibration voltage $V_{DC2}+V_{AC2}$ in a rectangular wave form obtained by superimposing the second alternating voltage $V_2$ onto the second direct voltage $V_{DC2}$ of −300 V, a vibration electric field (first electric field) is formed between the transporting roller 54 and the developing roller 48. In the supplying spatial region 90, the toner electrified into negative polarity receives the effect of the vibration electric field, so as to be electrically sucked from the transporting roller 54 to the developing roller 48. At this time, the carrier electrified into positive polarity is held onto the transporting roller 54 by the magnetic force of the fixed magnet unit 58 inside the transporting roller 54, so that the carrier is not supplied to the developing roller 48. In a developing spatial region 96, the negatively electrified toner held onto the developing roller 48 receives the effect of a vibration electric field (second electric field) formed between the developing roller 48 to which the vibration voltage $V_{DC2}+V_{AC2}$ in the rectangular wave form is applied and an electrostatic latent image region $V_L$ (for example, −80 V), so as to adhere onto the electrostatic latent image region. The first power source 120 and the second power source 130 constitute a first electric field forming device, and the second power source 130 constitutes a second electric field forming device.

In the developing device 34 are set up the following: a first detecting block 125 for detecting a current flowing in the first power source 120 connected to the transporting roller 54; and a second detecting block 135 for detecting a current flowing in the second power source 130 connected to the developing roller 48. As will be detailed later, the detecting block 125 has in the power source 120 a resistance between the DC power source 121 and the AC power source 122 so as to be connected in series to the sources 121 and 122 and further has a monitor voltage through which a voltage in a predetermined position between this resistance and the AC power source 122 is detected. In the same manner, the detecting block 135 has a resistance and a monitor voltage in the power source 130. From voltages detected through the monitor voltages, currents flowing in the power sources 120 and 130 can be detected.

The first detecting block 125 and the second detecting block 135 are each connected to a control unit 21 for controlling synthetically operations of the constituents related to the image forming apparatus 1, for example, rotational drivings of the photoreceptor 12, the developing roller 48 and the transporting roller 54, and operations of the electrifier 26, the exposing device 28, the developing device 34, the transferring device 36 and the electric field forming device 110. The control unit 21 is equipped with an electric field control unit 21*a* as an electric field controlling device for controlling operations of the first power source 120 and the second power source 130 on the basis of the currents flowing in the first power source 120 and the second power source 130, which are detected by the first detecting block 125 and the second detecting block 135, respectively. The control unit 21 is also equipped with a load capacity calculating unit 21*b* as a load capacity calculating device for calculating a load capacity of the developing spatial region 96 on the basis of the currents flowing in the first power source 120 and the second power source 130, which are detected by the first detecting block 125 and the second detecting block 135, respectively. Specifically, the electric field control unit 21*a* controls operations of the first power source 120 and the second power source 130 on the basis of the load capacity of the developing spatial region 96, which is calculated by the load capacity calculating unit 21*b*. The control unit 21 is configured mainly of, for example, a microcomputer.

The load capacity of the developing spatial region 96 is described as follows.

Figure 4:
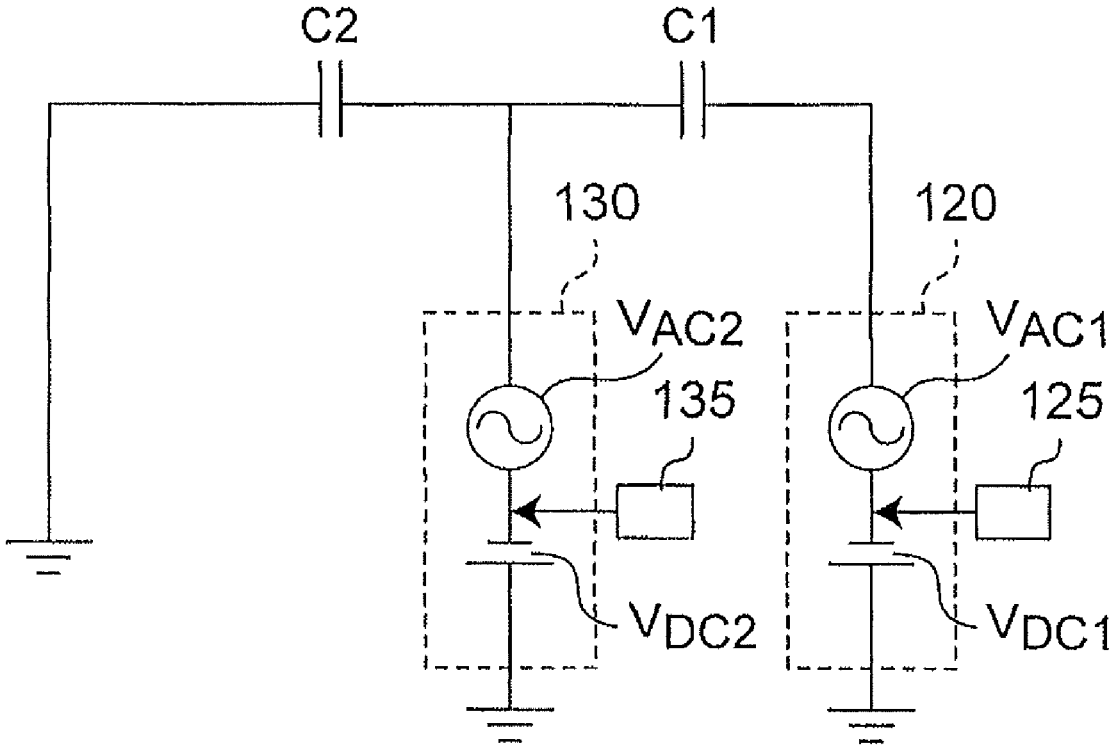
FIG. 4 is a diagram showing a circuit equivalent to a circuit composed of a developing device and a photoreceptor in the image forming apparatus.

FIG. 4 is a diagram showing a circuit equivalent to a circuit composed of the developing device and the photoreceptor in the image forming apparatus. In FIG. 4, the following case is illustrated as the equivalent circuit: the case of applying the vibration voltage $V_{DC2}+V_{AC2}$ obtained by superimposing the second alternating voltage $V_{AC2}$ onto the second direct voltage $V_{DC2}$ to the developing roller 48 arranged to interpose the developing gap 50 between the roller 48 and the photoreceptor 12, and applying the vibration voltage $V_{DC1}+V_{AC1}$ obtained by superimposing the first alternating voltage $V_{AC1}$ onto the first direct voltage $V_{DC1}$ to the transporting roller 54 arranged to interpose the supplying/collecting gap 56 between the roller 54 and the developing roller 48.

The equivalent circuit of the circuit composed of the developing device 34 and the photoreceptor 12 is illustrated as a circuit wherein (a) a first capacitor C1 and a second capacitor C2 are connected in series to the first power source 120, the capacitor C1 being composed of the transporting roller 54 and the developing roller 48 opposite to each other so as to interpose the supplying/collecting gap 56 therebetween and the capacitor C2 being composed of the developing roller 48 and the photoreceptor 12 opposite to each other so as to interpose the developing gap 50 therebetween, and further (b) the second power source 130 is connected to a point (not any end point) of the electric line for connecting the first capacitor C1 and the second condense C2 to each other.

A load capacity C of each of the first capacitor C1 and the second capacitor C2 can be represented by the following equation:

$$C=\in\times S/d$$

wherein $\in$ represents the dielectric constant of each of the first and second capacitors C1 and C2, S represents the area thereof, and d represents the thickness thereof. In the embodiment, regarding the first capacitor C1, S represents the opposite area between the transporting roller 54 and the developing roller 48 in the supplying/collecting spatial region 88, and d represents the length of the supplying/collecting gap 56 in the supplying/collecting spatial region 88; and regarding the second capacitor C2, S represents the opposite area between the developing roller 48 and the photoreceptor 12 in the developing spatial region 96, and d represents the length of the developing gap 50 in the developing spatial region 96.

As shown by the above equation, the load capacities C of the first and second capacitors C1 and C2 are changed in accordance with the length of the supplying/collecting gap 56 and that of the developing gap 50, respectively. As the supplying/collecting gap 56 and the developing gap 50 become larger, the load capacities become smaller. As the gaps 56 and 50 become smaller, the load capacities become larger.

Accordingly, the above load capacity of the developing spatial region 96 means the load capacity of the capacitor C2 composed of the developing roller 48 and the photoreceptor 12 opposed to each other to interpose the developing spatial region 96 therebetween. As the gap 50 of the developing spatial region 96 formed between the developing roller 48 and the photoreceptor 12 becomes larger, the load capacity becomes smaller. To the contrary, as the gap 50 becomes smaller, the load capacity becomes larger. As will be detailed later, the load capacity of the supplying/collecting spatial region 88 means the load capacity of the capacitor C1 composed of the transporting roller 54 and the developing roller 48 opposed to each other to interpose the supplying/collecting spatial region 88 therebetween. As the gap 56 of the supplying/collecting spatial region 88 formed between the transporting roller 54 and the developing roller 48 becomes larger, the load capacity becomes smaller. To the contrary, as the gap 56 becomes smaller, the load capacity becomes larger.

The following will describe the operation of the developing device 34 having this structure. When an image is formed, the developing roller 48 and the transporting roller 54 are rotated in directions represented by arrows 78 and 80, respectively, by the driving of the motor. The front screw 72 and the rear screw 74 are rotated in directions represented by arrows 82 and 84, respectively. In this way, the developer 2 held in the developer agitating room 66 is agitated while circularly transported between the front room 68 and the rear room 70. As a result, the toner 6 and the carrier contained in the developer 2 undergo fractional contact so that they are electrified into polarities reverse to each other. In the embodiment, the carrier and the toner are electrified into positive polarity and negative polarity, respectively. The particles of the carrier are larger than those of the toner; thus, the toner particles electrified into negative polarity adhere to the peripheries of the carrier particles electrified into positive polarity mainly by electrically attractive force between the both particles.

The electrified developer 2 is supplied to the transporting roller 54 in the step in which the developer 2 is transported in the front room 68 by the front screw 72. Near the magnetic pole N3, the developer 2 supplied to the transporting roller 54 by the front screw 72 is held onto the transporting roller 54, specifically, the outer circumferential surface of the sleeve 60 by magnetic force of the magnetic pole N3. The developer 2 held onto the sleeve 60 constitutes a magnetic brush along magnetic force lines made by the magnetic unit 58, and is counterclockwise transported in accordance with the rotation of the sleeve 60. Regarding the developer 2 held onto the magnetic pole S1 in a spatial region (regulating region) 86 opposite to the regulating plate 62, the amount thereof that passes through the regulating gap 64 is regulated to a predetermined amount by the regulating plate 62. The developer that has passed through the regulating gap 64 is transported into the spatial region 88 between the developing roller 48 and the transporting roller 54 opposed to each other, the region 88 being opposite to the magnetic pole N1.

As described above, inside the supplying/collecting spatial region 88, mainly in the spatial region 90 at the upstream side of the region 88 in the rotating direction of the sleeve 60, the toner 6 adhering to the carrier is electrically supplied to the developing roller 48 by the existence of an electric field formed between the developing roller 48 and the transporting roller 54, so that the toner 6 is shifted from the transporting roller 54 to the developing roller 48.

The toner 6 held onto the developing roller 48 in the supplying spatial region 90 is counterclockwise transported to the accompaniment of the rotation of the developing roller 48, and then adheres, in the developing spatial region 96, onto an electrostatic latent image region formed on the outer circumferential surface of the photoreceptor 12. In the image forming apparatus 1, a negative predetermined potential $V_H$ (for example, −600 V) is given to the outer circumferential surface of the photoreceptor 12 by the electrifier 26. The electrostatic latent image region, on which the image light ray 30 is projected by the exposing device 28, is attenuated into a predetermined potential $V_L$ (for example, −80 V) while the non-electrostatic latent image region on which the image light ray 30 is not projected by the exposing device 28 substantially keeps the electrification potential $V_H$. Accordingly, in the developing spatial region 96, the toner 6 electrified into negative polarity receives the effect of the electric field formed between the photoreceptor 12 and the developing roller 48 so as to adhere to the electrostatic latent image region. This electrostatic latent image is made into a visible image as a toner image.

In the meantime, a fraction of the toner 6 that remains on the developing roller 48 after the development, without being supplied for the development, is transported in a direction represented by an arrow 78 in accordance with the rotation of the developing roller 48. Inside the supplying/collecting spatial region 88, mainly in the spatial region 92 at the downstream side of the region 88 in the rotation direction of the sleeve 60, the fraction of the toner 6 is scratched away by the magnetic brush formed along the magnetic force lines of the magnetic pole N1, and then collected onto the transporting roller 54. The developer 2 containing the fraction of the toner 6 collected on the transporting roller 54 is held by magnetic force of the magnetic unit 58. When the developer 2 is passed through a spatial region opposite to the magnetic pole S2 to the accompaniment of the rotation of the transporting roller 54 to arrive at a spatial region (releasing region) 94 between the magnetic poles N2 and N3 opposite to each other, the developer 2 is released from the outer circumferential surface of the transporting roller 54 into the front room 68 by a repulsive magnetic field formed by the magnetic poles N2 and N3, so as to be incorporated into the developer 2 that is being transported in the front room 68.

The following will describe specific materials of the toner and the carrier, which constitute the developer 2, and those of other particles contained in the developer 2.

The toner may be a known one that has been conventionally used in image forming apparatuses. The toner particle diameter is, for example, from about 3 to 15 μm. The toner may be one in which a colorant is incorporated into a binder resin, one containing a charge control agent or a releasing agent, or one having a surface for holding an additive. The toner may be produced by, for example, a pulverizing method, an emulsion polymerization method, or a suspension polymerization method, or any other known method.

The carrier may be a known one that has been conventionally and generally used. The carrier may be either of a binder type or of a coat type. The carrier particle diameter, which is not limited, is preferably from about 15 to 100 μm.

The binder type carrier is one in which fine magnetic-material particles are dispersed in a binder resin, and may be one having a surface containing fine particles or a coating layer chargeable into positive or negative polarity. The polarity of the binder type carrier and other electrification properties thereof may be controlled by the material of the binder resin, the kind of the chargeable fine particles or the surface coating layer.

Examples of the binder resin used in the binder type carrier include vinyl resins, a typical example of which is polystyrene resin, polyester resins, nylon resins, polyolefin resins, and other thermoplastic resins; and phenol resin and other thermosetting resins.

The fine magnetic-material particles of the binder type carrier may be magnetite particles, spinel ferrite particles such as gamma iron oxide particles, spinel ferrite particles containing one or more of metals other than iron (such as Mn, Ni, Mg and Cu), barium ferrite particles, other magnetoplumbite type ferrite particles, or iron or alloy particles having surfaces containing iron oxide. The carrier may have a granular form, a spherical form, a needle form, or any other form. When a particularly high magnetization is required, it is preferred to use iron based ferromagnetic fine particles. Considering chemical stability, it is preferred to use ferromagnetic fine particles made of magnetite, spinel ferrite containing gamma iron oxide, barium ferrite, or any other magnetoplumbite type ferrite. By selecting the kind of the ferromagnetic fine particles or the content by percentage thereof appropriately, a magnetic resin carrier having a desired magnetization can be obtained. It is proper to add the fine magnetic-material particles to the magnetic resin carrier in a proportion of 50 to 90% by weight.

The material of the surface coating layer of the binder type carrier may be silicone resin, acrylic resin, epoxy resin, fluorine-contained resin, or the like. When the carrier surface is coated with the resin and then the resin is cured to form a coating layer, the charge-giving capability of the carrier can be improved.

The fixation or bonding of the chargeable fine particles or conductive fine particles onto the surface of the binder type carrier is attained, for example, by mixing a magnetic resin carrier as the binder type carrier with the fine particles into a homogeneous state to cause the fine particles to adhere onto the surface of the magnetic resin carrier, and then giving mechanical or thermal impact force thereto, thereby sinking the fine particles into the magnetic resin carrier. In this case, the fixation is not attained in such a manner that the fine particles are completely embedded in the magnetic resin carrier, but is attained in such a manner that the fine particles are partially projected from the magnetic resin carrier surface. The chargeable fine particles may be made of an organic or inorganic insulating material. Specific examples of the organic insulating material include fine particles of polystyrene, styrene based copolymer, acrylic resin, various acrylic copolymers, nylon, polyethylene, polypropylene, and fluorine-contained resin; and crosslinked materials thereof. The charge-giving capability and the electrified polarity can be adjusted by the material of the chargeable fine particles, a catalyst for polymerization for yielding the particles, surface treatment applied to the particles, or the like. Specific examples of the inorganic insulating material include silica, titanium dioxide, and other inorganic materials chargeable into negative polarity; and strontium titanate, alumina, and other inorganic materials chargeable into positive polarity.

The coat type carrier is one in which carrier core particles made of a magnetic material are coated with a resin. In the same manner as in the case of the binder type carrier, chargeable fine particles, which can be charged into positive polarity or negative polarity, can be fixed and bonded onto the carrier surface. The polarity of the coat type carrier or other electrification properties thereof can be adjusted by the kind of the surface coating layer or the chargeable fine particles. The coating resin may be identical to the binder resin of the binder type carrier.

It is sufficient for the blend ratio between the toner and the carrier to be adjusted to give a desired charge amount of the toner. The proportion of the toner is preferably from 3 to 50% by weight of the total of the toner and the carrier, more preferably from 6 to 30% by weight thereof.

The binder resin used in the toner is not limited, and examples thereof include styrene based resins (homopolymers or copolymers containing styrene or a substituted styrene compound), polyester resins, epoxy resins, vinyl chloride resins, phenol resins, polyethylene resins, polypropylene resins, polyurethane resins, silicone resins, and any resin in which two or more of these resins are mixed at any ratio. The binder resin preferably has a softening temperature of about 80 to 160° C., and a glass transition temperature of about 50 to 75° C.

The colorant used for the toner may be a known material, such as carbon black, aniline black, activated carbon, magnetite, benzine yellow, permanent yellow, naphthol yellow, phthalocyanine blue, fast sky blue, ultramarine blue, rose bengal, or lake red. In general, the addition amount of the colorant is preferably from 2 to 20 parts by weight for 100 parts by weight of the binder resin.

The charge control agent used for the toner may be a material that has been conventionally used as a charge control agent. Specific examples thereof for the toner electrified into positive polarity include nigrosin dyes, quaternary ammonium salt based compounds, triphenylmethane based compounds, imidazole based compounds, and polyamine resins. Specific examples thereof for the toner electrified into negative polarity include azo dyes each containing a metal such as Cr, Co, Al or Fe, salicylic acid metal compounds, alkylsalicylic acid metal compounds, and calixarene compounds. The charge control agent is used preferably in a proportion of 0.1 to 10 parts by weight for 100 parts by weight of the binder resin.

The releasing agent used for the toner may be a material that has been conventionally used as a releasing agent. Examples of the releasing agent include polyethylene, polypropylene, carnauba wax, Sasol wax, and any mixture in which two or more thereof are appropriately combined with each other. The releasing agent is used preferably in a proportion of 0.1 to 10 parts by weight for 100 parts by weight of the binder resin.

Additionally, a fluidizer for promoting the fluidization of the developer may be added to the toner. The fluidizer may be, for example, inorganic particles made of silica, titanium oxide or aluminum oxide. The fluidizer is in particular preferably a material made hydrophobic with a silane coupling agent, a titanium coupling agent, a silicone oil, or the like. The fluidizer is added preferably in a proportion of 0.1 to 5 parts by weight for 100 parts by weight of the toner. The number-average primary particle diameter of these additives is preferably from 9 to 100 nm.

In a case where in the developing device 34 in a hybrid developing manner, which has the above-mentioned structure, the length of the developing gap 50 of the developing spatial region 96 formed between the developing roller 48 and the photoreceptor 12 is varied, density unevenness resulting from the gap length variation may be generated in an obtained image, as described above. However, in the developing device 34 according to the embodiment, a current flowing in the first power source 120 and a current flowing in the second power source 130 are detected. On the basis of the detected currents, which flow in the first and second power sources 120 and 130, respectively, the operation of the second power source 130 is controlled. Specifically, on the basis of these detected currents, the load capacity of the developing spatial region 96 is calculated. On the basis of the calculated load capacity of the developing spatial region 96, the operation of the second power source 130 is controlled. In this way, the problem of the density unevenness is avoided.

The following will describe a method for detecting the currents flowing in the first power source 120 and the second power source 130, respectively, a method for calculating the load capacity of the developing spatial region 96, and the control of the operation of the second power source 130 in the developing device 34 according to the embodiment.

As illustrated in FIG. 2, in the image forming apparatus 1, the photoreceptor 12 is connected to the ground 116. In the developing device 34, the transporting roller 54 is connected to the ground 116 through the first power source 120 composed of the first DC power source 121 and the first AC power source 122, and the developing roller 48 is connected to the ground 116 through the second power source 130 composed of the second DC power source 131 and the second AC power source 132.

As illustrated in FIG. 4, the equivalent circuit of the circuit composed of the developing device 34 and the photoreceptor 12 is represented as a circuit in which the first capacitor C1, which is composed of the transporting roller 54 and the developing roller 48 opposite to each other to interpose the supplying/collecting gap 56 therebetween, and the second capacitor C2, which is composed of the developing roller 48 and the photoreceptor 12 opposite to each other to interpose the developing gap 50 therebetween, are connected in series to the first power source 120, and further the second power source 130 is connected between the first capacitor C1 and the second condense C2 to each other.

Firstly, the method for detecting the currents flowing in the first power source 120 and the second power source 130, respectively, is described herein.

Figure 5:
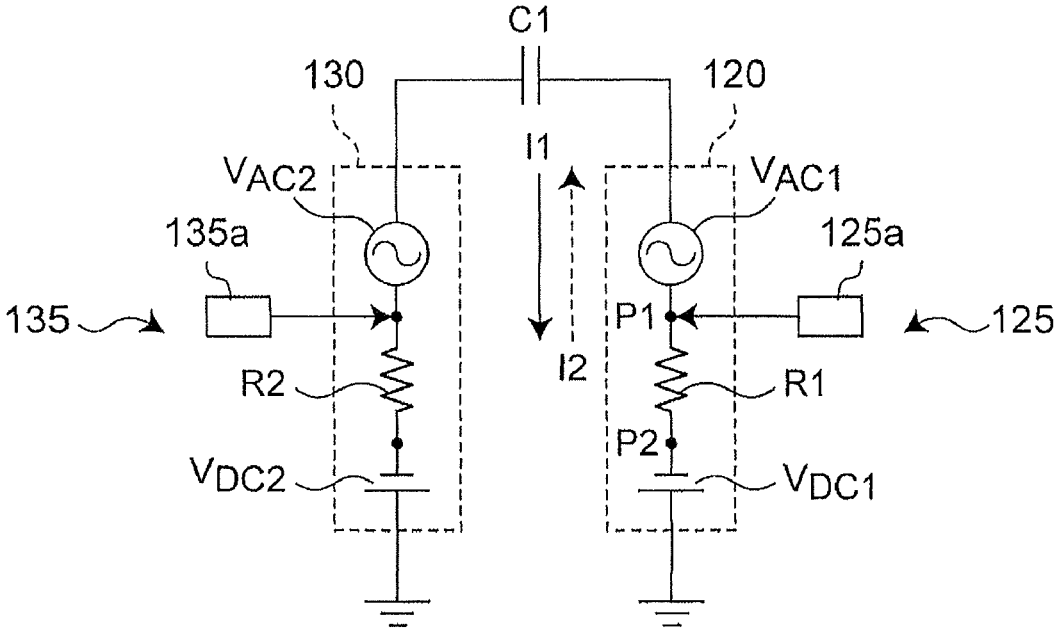
FIG. 5 is a diagram referred to in order to describe a method for detecting currents flowing in power sources by means of detecting blocks.
Figure 6:
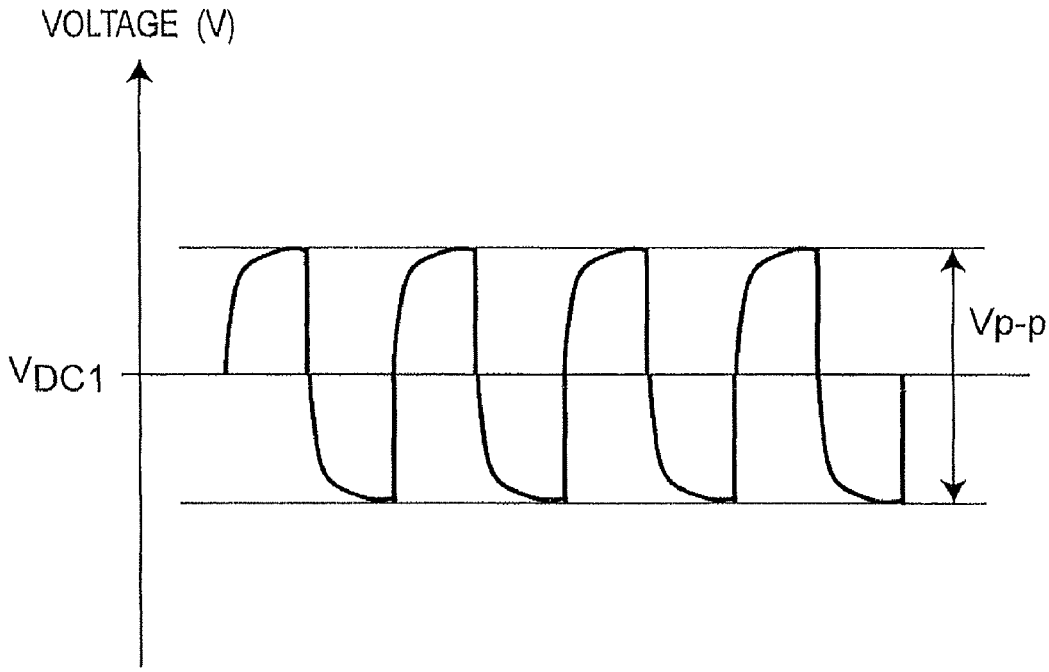
FIG. 6 is a graph showing detected values of the monitor voltage of one of the detecting blocks.

FIG. 5 is a diagram referred to in order to describe the method for detecting the currents flowing in the power sources by means of the detecting blocks 125 and 135. In FIG. 5 is shown a circuit composed of the first power source 120, the first capacitor C1 and the second power source 130 illustrated in FIG. 4. FIG. 6 is a graph showing detected values of the monitor voltage of one of the detecting blocks. FIG. 6 shows the detected values of the monitor voltage of the first detecting block 125 for detecting the current flowing in the first power source 120.

As illustrated in FIG. 5, the first detecting block 125 has, inside the first power source 120, a resistance R1 between the first DC power source 121 and the first AC power source 122 so as to be connected in series to the power sources 121 and 122, and has a monitor voltage (first monitor voltage) 125*a* through which the voltage of a predetermined position P1 between the resistance R1 and the first AC power source 122 is detected. From the voltage detected through the monitor voltage 125*a*, the current flowing in the first power source 120 can be detected.

Specifically, in the circuit illustrated in FIG. 5, the voltage detected through the monitor voltage 125*a*, that is, the voltage detected at the position P1 is represented as a voltage waveform having an amplitude $V_{P\text{-}P}$ relative to the center of a voltage $V_{DC1}$ at a position P2 as illustrated in FIG. 6. When a current I1 flows in a direction represented by a solid line arrow in FIG. 5, the following is detected as the monitor voltage 125*a*: a voltage represented by $[V_{DC1}+(R1\times I1)]$, which is higher than the voltage $V_{DC1}$ at the position P2. When a current I2 flows in a direction represented by a broken line arrow in FIG. 5, the following is detected as the monitor voltage 125*a*: a voltage represented by $[V_{DC1}-(R1\times I2)]$, which is lower than the voltage $V_{DC1}$ at the position P2. The current flowing in the first power source 120 can be detected from the voltage detected through the monitor voltage 125*a* and the resistance R1. In this way, the first detecting block 125 can detect the current flowing in the first power source 120 from the voltage detected through the monitor voltage 125*a*.

In the similar way, the second detecting block 135 has, inside the second power source 130, a resistance R2 between the second DC power source 131 and the second AC power source 132 so as to be connected in series to the power sources 131 and 132, and has a monitor voltage (second monitor voltage) 135*a* through which the voltage of a predetermined position between the resistance R2 and the second AC power source 132 is detected. From the voltage detected through the monitor voltage 135*a*, the current flowing in the second power source 130 can be detected.

Secondly, the calculation method for calculating the load capacity of the developing spatial region 96 is described below.

In order to calculate the load capacity of the developing spatial region 96, on the basis of the current detected by the first detecting block 125, the voltage between the front and the rear of the resistance R1 in the first detecting block 125 has been detected from this current and the resistance R1 in the first detecting block 125, and further on the basis of the current detected by the second detecting block 135, the voltage between the front and the rear of the resistance R2 in the second detecting block 135 has been detected from this current and the resistance R2 in the second detecting block 135. The following have then been examined: a relationship between the load capacity of the supplying/collecting spatial region 88 and the amplitude of the voltage between the front and the rear of the resistance R1 in the first detecting block 125; and a relationship between the load capacity of the developing spatial region 96 and the amplitude of the voltage between the front and the rear of the resistance R2 in the second detecting block 135.

In the embodiment, the amplitude of the voltage between the front and the rear of the resistance R1 in the first detecting block 125, and that of the voltage between the front and the rear of the resistance R2 in the second detecting block 135 are equal to the amplitude of the voltage detected through the first monitor voltage 125*a* and that of the voltage detected through the second monitor voltage 135*a*, respectively; therefore, the following have been examined: a relationship, between the load capacity of the supplying/collecting spatial region 88 and the amplitude of the voltage detected through the monitor voltage 125*a* of the first detecting block 125; and a relationship between the load capacity of the developing spatial region 96 and the amplitude of the voltage detected through the monitor voltage 135*a* of the second detecting block 135.

Specifically, as illustrated in FIG. 4, the first capacitor C1, which imitates the supplying/collecting spatial region 88 having a predetermined load capacity, and the second capacitor C2, which imitates the developing spatial region 96 having a predetermined capacity, have been connected in series to the first power source 120; the second power source 130 has been connected in between the first and second capacitors C1 and C2; predetermined voltages have been applied to the first power source 120 and the second power source 130, respectively; and then the following have been examined: a relationship between the load capacity of the first capacitor C1 and the amplitude of the monitor voltage of the first detecting block 125, and a relationship between the load capacity of the second capacitor C2 and the amplitude of the monitor voltage of the second detecting block 135.

Capacitors having load capacities of 50 pF, 100 pF and 200 pF, respectively, have each been used as the first capacitor C1. In cases of using as the first capacitor C1 each of the capacitors having the load capacities of 50 pF, 100 pF and 200 pF, respectively, capacitors having load capacities of 50 pF, 100 pF and 200 pF, respectively, have each been used as the second capacitor C2. In this manner, the above-mentioned relationships have been examined.

Figure 7:
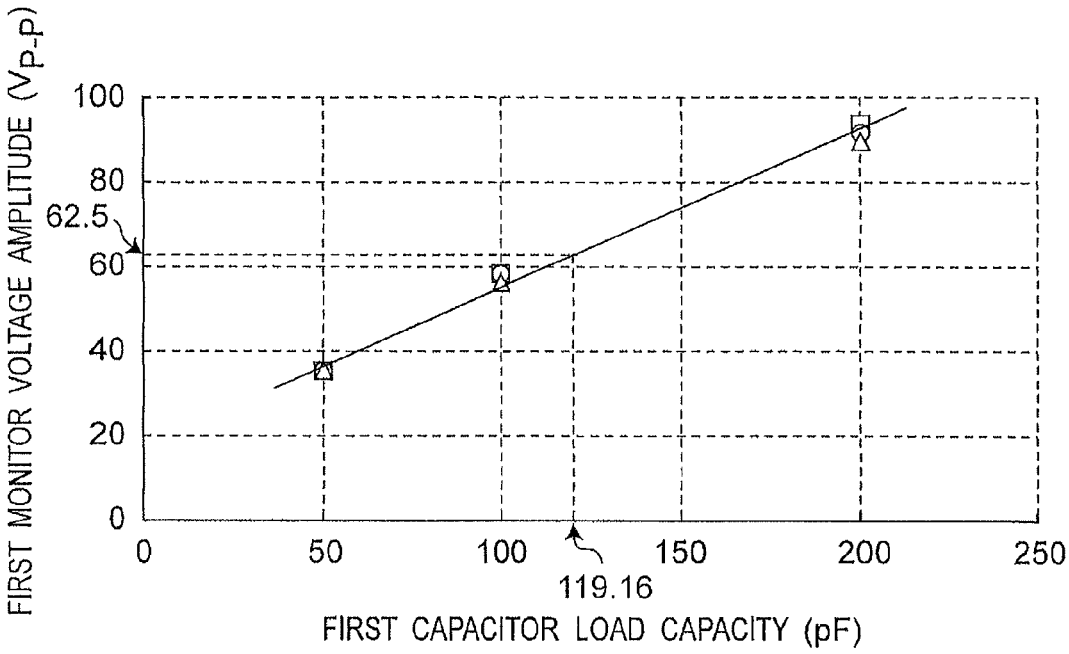
FIG. 7 is a graph showing a relationship between the load capacity of a first capacitor and the amplitude of a first monitor voltage.

FIG. 7 is a graph showing a relationship between the load capacity of the first capacitor C1 and the amplitude of the first monitor voltage. In FIG. 7, the transverse axis of the graph represents the load capacity of the first capacitor C1, and the vertical axis thereof represents the amplitude of the first monitor voltage. In FIG. 7, the cases of the second capacitors C2 having the load capacities of 50 pF, 100 pF and 200 pF, respectively, are represented by □, ○, and Δ, respectively.

As shown in FIG. 7, in the case where the load capacity of the first capacitor C1 is 50 pF, the amplitude of the first monitor voltage is substantially constant even when any one of the second capacitors C2 having the load capacities of 50 pF, 100 pF and 200 pF, respectively, is used. Also in the cases where the load capacities of the first capacitors C1 are 100 pF and 200 pF, respectively, it is understood that the amplitude of the first monitor voltage is substantially constant even when any one of the second capacitors C2 having the load capacities of 50 pF, 100 pF and 200 pF, respectively, is used. From these results, it is understood that the relationship between the load capacity of the first capacitor C1 and the amplitude of the first monitor voltage does not substantially depend on the load capacity of the second capacitor C2.

As represented by a solid line in FIG. 7, the load capacity of the first capacitor C1 and the amplitude of the first monitor voltage have a substantial proportionality. Thus, it is understood that the amplitude of the first monitor voltage becomes larger as the load capacity of the first capacitor C1 becomes larger. Accordingly, it is understood that in the developing device 34 represented by the equivalent circuit shown in FIG. 9, the relationship between the load capacity of the supplying/collecting spatial region 88 and the amplitude of the first monitor voltage is represented by the solid line in FIG. 7. Consequently, in the developing device 34, the load capacity of the supplying/collecting spatial region 88 can be calculated from the amplitude of the first monitor voltage on the basis of the solid line in FIG. 7.

Figure 8:
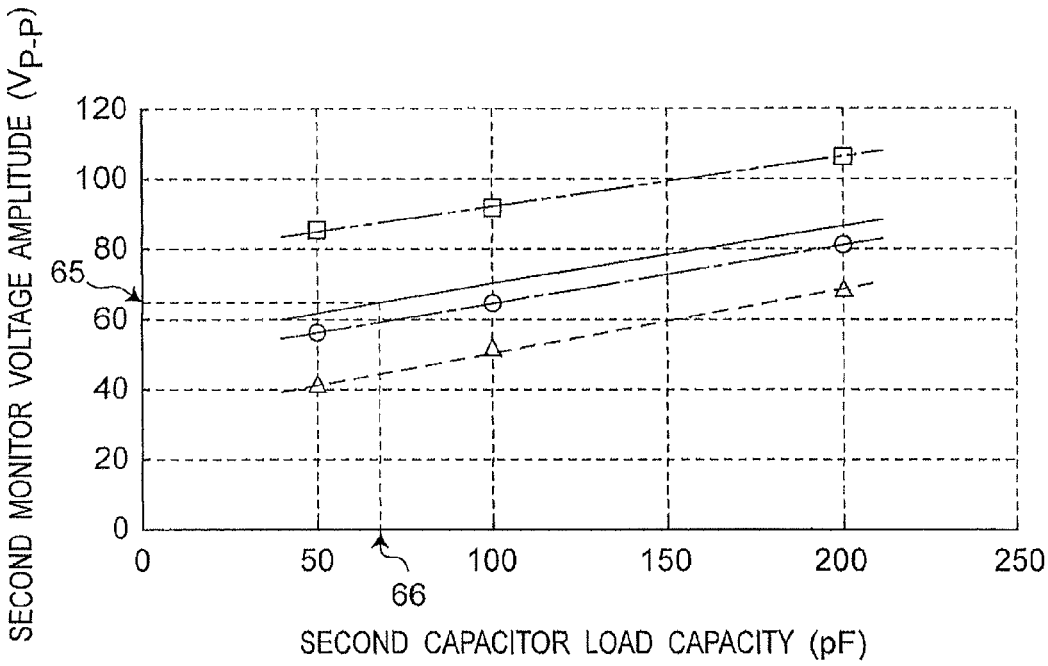
FIG. 8 is a graph showing a relationship between the load capacity of a second capacitor and the amplitude of a second monitor voltage.

FIG. 8 is a graph showing a relationship between the load capacity of the second capacitor C2 and the amplitude of the second monitor voltage. In FIG. 8, the transverse axis of the graph represents the load capacity of the second capacitor C2, and the vertical axis thereof represents the amplitude of the second monitor voltage. In FIG. 8, the cases of the first capacitors C1 having the load capacities of 50 pF, 100 pF and 200 pF, respectively, are represented by Δ, ○, and □, respectively.

As represented by a broken line in FIG. 8, in the case of the first capacitor C1 having the load capacity of 50 pF, the load capacity of the second capacitor C2 and the amplitude of the second monitor voltage have a substantial proportionality. Thus, it is understood that the amplitude of the second monitor voltage becomes larger as the load capacity of the second capacitor C2 becomes larger. Also in the cases of the first capacitors C1 having the load capacities of 100 pF and 200 pF, respectively, it is understood, as shown by an alternate long and short dash line and an alternate long and two short dash line in FIG. 8, respectively, that the load capacity of the second capacitor C2 and the amplitude of the second monitor voltage have a substantial proportionality and the amplitude of the second monitor voltage becomes larger as the load capacity of the second capacitor C2 becomes larger.

As illustrated in FIG. 8, a line representing the relationship between the load capacity of the second capacitor C2 and the amplitude of the second monitor voltage has a substantially constant gradient in any one of the cases of the first capacitors C1 having the load capacities of 50 pF, 100 pF and 200 pF, respectively. The line is shifted upward as the load capacity of the first capacitor C1 becomes larger. Accordingly, it is understood about the developing device 34 represented by the equivalent circuit shown in FIG. 4 that a line representing the relationship between the load capacity of the developing spatial region 96 and the amplitude of the second monitor voltage has a gradient equal to that of the broken line, the alternate long and short dash line, and the alternate long and two short dash line in FIG. 8, and the relationship is represented by the line that is shifted upward or downward in accordance with the load capacity of the supplying/collecting spatial region 88. Consequently, in the developing device 34, the load capacity of the developing spatial region 96 can be calculated from the amplitude of the second monitor voltage on the basis of the line corresponding to the load capacity of the supplying/collecting spatial region 88 as illustrated in FIG. 8.

Accordingly, in the developing device 34, at the time of for example, forming no image, the current flowing in the first power source 120 is detected by the first detecting block 125 and further the current flowing in the second power source 130 is detected by the second detecting block 135, while the voltage between the front and the rear of the resistance R1 in the first detecting block 125 is detected from the current flowing in the first power source 120 and further the voltage between the front and the rear of the resistance R2 in the second detecting block 135 is detected from the current flowing in the second power source 130. From the amplitude of the detected voltage between the front and the rear of the resistance R1 in the first detecting block 125 (in particular, from the amplitude of the voltage detected through the first monitor voltage 125*a* of the first detecting block 125 in the embodiment), the load capacity of the supplying/collecting spatial region 88 can be calculated on the basis of the relationship between the load capacity of the supplying/collecting spatial region 88 and the amplitude of the first monitor voltage.

Next, from the calculated load capacity of the supplying/collecting spatial region 88, the relationship between the load capacity of the developing spatial region 96 and the amplitude of the voltage between the front and the rear of the resistance R2 in the second detecting block is calculated. In the embodiment, the relationship between the load capacity of the developing spatial region 96 and the amplitude of the second monitor voltage is calculated. From the amplitude of the voltage detected through the first monitor voltage 125*a* of the first detecting block 125, the load capacity of the developing spatial region 96 can be calculated on the basis of the relationship between the load capacity of the developing spatial region 96 corresponding to the calculated load capacity of the supplying/collecting spatial region 88 and the amplitude of the second monitor voltage.

The following will specifically describe the calculation of the load capacity of the developing spatial region 96, giving, as an example, a case where the amplitude $V_{P-P}$ of the monitor voltage of the first detecting block 125 is 62.5 V and the amplitude $V_{P-P}$ of the monitor voltage of the second detecting block 135 is 65 V.

When the amplitude $V_{P-P}$ of the first monitor voltage detected by the first detecting block 125 is 62.5 V in the developing device 34, the load capacity of the supplying/collecting spatial region 88 is calculated as 119.16 pF on the basis of the relationship between the load capacity of the first capacitor C1, which imitates the supplying/collecting spatial region 88 illustrated in FIG. 7, and the amplitude of the first monitor voltage. From the calculated load capacity of the supplying/collecting spatial region 88, the relationship between the load capacity of the second capacitor C2, which imitates the developing spatial region 96, and the amplitude of the second monitor voltage is obtained as represented by a solid line in FIG. 8 about the case where the load capacity of the supplying/collecting spatial region 88 is 119.16 pF.

The amplitude $V_{P-P}$ of the second monitor voltage detected by the second detecting block 135 is 65 V; therefore, in the case where the load capacity of the supplying/collecting spatial region 88, which is represented by the solid line in FIG. 8, is 119.16 pF, the load capacity of the developing spatial region 96 is calculated as 66 pF on the basis of the line showing the relationship between the load capacity of the second capacitor C2 and the amplitude of the second monitor voltage.

In this way, in the developing device 34, the relationship between the load capacity of the first capacitor C1, which imitates the supplying/collecting spatial region 88, and the amplitude of the first monitor voltage is beforehand calculated as well as the relationship between the load capacity of the second capacitor C2, which imitates the developing spatial region 96, and the amplitude of the second monitor voltage, thereby making it possible to calculate the load capacity of the developing spatial region 96 from the amplitude of the first monitor voltage and that of the second monitor voltage.

In the control unit 21 are beforehand memorized the two relationships (i.e., the relationship between the load capacity of the first capacitor C1, which imitates the supplying/collecting spatial region 88, and the amplitude of the first monitor voltage, and the relationship between the load capacity of the second capacitor C2, which imitates the developing spatial region 96, and the amplitude of the second monitor voltage). The control unit 21 can calculate, in the load capacity calculating section 21*b*, the load capacity of the developing spatial region 96 on the basis of the amplitude of the first monitor voltage and that of the second monitor voltage.

When an image is formed, the control unit 21 controls, in the electric field controlling section 21*a*, the operation of the first power source 120 and that of the second power source 130 to set the load capacity of the developing spatial region 96 to a predetermined value. However, when no image is formed, for example, every time after a predetermined number of sheets are subjected to image-forming steps, the load capacity calculating section 21*b* calculates the load capacity of the developing spatial region 96 on the basis of the amplitude of the first monitor voltage and that of the second monitor voltage, and then the electric field controlling section 21*a* judges whether or not the load capacity of the developing spatial region 96 is in a given range set beforehand relative to the predetermined value. When the load capacity of the developing spatial region 96 is judged not to be in the given range set beforehand, the operation of the second power source 130 can be caused to undergo feedback control.

In a case where the load capacity of the developing spatial region 96 is judged not to be in the given range set beforehand relative to the predetermined value, the control unit 21 controls the operation of the second power source 130 to make the toner amount to be shifted from the developing roller 48 to the photoreceptor 12 small when the control unit 21 judges that the load capacity of the developing spatial region 96 is larger than the predetermined value. Preferably, the control unit 21 controls the operation of the second power source 130 to make the amplitude $V_{P-P}$ of the second alternating voltage $V_{AC2}$ of the second power source 130 small. In this way, in the developing device 34, the load capacity of the developing spatial region 96 may become larger upward from the given range relative to the predetermined value set beforehand so that the developing gap 50 of the developing spatial region 96 may become small. In the case where the gap 50 becomes small, the toner amount to be shifted from the developing roller 48 to the photoreceptor 12 can be made small, so that a rise in the density of a toner image to be obtained can be restrained.

On the other hand, in a case where the load capacity of the developing spatial region 96 is judged not to be in the given range set beforehand relative to the predetermined value, the control unit 21 controls the operation of the second power source 130 to make the toner amount to be shifted from the developing roller 48 to the photoreceptor 12 large when the control unit 21 judges that the load capacity of the developing spatial region 96 is smaller than the predetermined value. Preferably, the control unit 21 controls the operation of the second power source 130 to make the amplitude $V_{P-P}$ of the second alternating voltage $V_{AC2}$ of the second power source 130 large. In this way, in the developing device 34, the load capacity of the developing spatial region 96 may become larger downward from the given range relative to the predetermined value set beforehand so that the developing gap 50 of the developing spatial region 96 may become large. In the case where the gap 50 becomes large, the toner amount to be shifted from the developing roller 48 to the photoreceptor 12 can be made large, so that a fall in the density of a toner image to be obtained can be restrained.

As described above, in a case where, in the developing device 34 according to the embodiment, the load capacity of the developing spatial region 96 is not in the given range relative to the predetermined value set beforehand, the operation of the second power source 130 is caused to undergo feedback control. As a result, the density of a toner image to be obtained can be made substantially constant even when the length of the developing gap 50 of the developing spatial region 96 formed between the developing roller 48 and the photoreceptor 12 is varied. Thus, density unevenness caused by the variation in the gap length in the developing spatial region 96 can be restrained so that a stable development can be attained.

In the developing device 34, the load capacity of the developing spatial region 96 is affected by an environmental condition for the device 34, such as temperature or humidity, or an endurance condition of the device 34, such as the number of sheets on which printing is to be made. Therefore, the load capacity of the developing spatial region 96 can be more precisely calculated by calculating the relationship between the load capacity of the supplying/collecting spatial region 88 and the amplitude of the first monitor voltage in accordance with the environmental condition or the endurance condition, and further calculating the relationship between the load capacity of the developing spatial region 96 and the amplitude of the second monitor voltage in accordance with the environmental condition or the endurance condition.

In the image forming apparatus 1, it is allowable to (a) set up an environmental condition detecting device (not illustrated) for detecting the environmental condition, such as a temperature sensor for measuring the temperature of the environment or a humidity sensor for measuring the humidity thereof, and/or an endurance condition detecting device (not illustrated) such as a counter for counting the number of sheets on which printing is to be made, (b) calculate the load capacity of the developing spatial region 96 by means of the control unit 21 on the basis of not only the currents flowing in the first and second power sources 120 and 130, respectively, but also input information from the environmental condition detecting device and/or the endurance condition detecting device, and (c) cause the operation of the second power source 130 to undergo feedback control on the basis of the calculated load capacity of the developing spatial region 96. This makes it possible to restrain density unevenness caused by a variation in the length of the developing gap 50 more precisely to attain a stabler development.

In the case of causing, in the developing device 34, the operation of the second power source 130 to undergo feedback control on the basis of the load capacity of the developing spatial region 96 as described above, it is preferred that the control unit 21, specifically the electric field controlling section 21*a* controls the operation of the second power source 130 and further controls the operation of the first power source 120 to make the electric field formed between the transporting roller 54 and the developing roller 48 substantially constant before and after the feedback control. This makes it possible to make the amount of the toner shifted from the transporting roller 54 to the developing roller 48 substantially constant to attain a stable development.

As described above, in the embodiment, the operation of the second power source 130 is controlled on the basis of the detected current flowing in the first power source 120 and the detected current flowing in the second power source 130. This manner allows to detect a variation in the gap length of the developing spatial region 96 formed between the developing roller 48 and the photoreceptor 12 from the currents flowing in the first and second power sources 120 and 130, respectively. The detection of the gap length variation in the developing spatial region 96 makes it possible to control the operation of the second electric field forming device 130 on the basis of the gap length variation. Thus, density unevenness caused by the gap length variation can be restrained so that a stable development can be attained.

In the embodiment, the following case has been given as an example: the case where the vibration voltage $V_{DC1}+V_{AC1}$ obtained by superimposing the first alternating voltage $V_{AC1}$ onto the first direct voltage $V_{DC1}$ is applied from the first power source 120 to the transporting roller 54, and the vibration voltage $V_{DC2}+V_{AC2}$ obtained by superimposing the second alternating voltage $V_{AC2}$ onto the second direct voltage $V_{DC2}$ is applied from the second power source 130 to the developing roller 48. However, the case allowable in the invention is not limited to this case. When the toner can be supplied from the transporting roller 54 to the developing roller 48 in the supplying/collecting spatial region 88, the following case is allowable: a case where any one of a direct voltage and a vibration voltage is applied from the first power source 120 to the transporting roller 54 and a vibration voltage is applied from the second power source 130 to the developing roller 48. In the case also, where any one of a direct voltage and a vibration voltage is applied to the transporting roller 54, density unevenness caused by the gap length variation in the developing spatial region 96 can be restrained by calculating the load capacity of the developing spatial region 96 on the basis of the current flowing in the first power source and that flowing in the second power source, and then controlling the operation of the second power source 130 on the basis of the calculated load capacity of the developing spatial region 96. As a result, a stable development can be attained.

As described above, the invention is not limited to the embodiments given as examples. It is needless to say that the embodiments may be modified into various forms or changed in design as far as the modified or changed embodiments do not depart from the subject matter of the invention.

What is claimed is:

1. A developing device, comprising:

a first transporting member that is rotatably driven, and holds, on an outer circumferential surface, a developer containing a toner and a carrier while the developer is transported, a second transporting member that is rotatably driven, and is opposite to the first transporting member to interpose a first spatial region between the members, and is opposite to an electrostatic latent image carrying member to interpose a second spatial region between the second transporting member and the carrying member, a first electric field forming device that includes a first power source connected to the first transporting member and a second power source connected to the second transporting member, forms a first electric field between the first and second transporting members, and shifts the toner in the developer held onto the first transporting member to the second transporting member, and a second electric field forming device that includes the second power source connected to the second transporting member, forms a second electric field between the second transporting member and the electrostatic latent image carrying member, and shifts the toner held onto the second transporting member to an electrostatic latent image of the electrostatic latent image carrying member, thereby converting the electrostatic latent image to a visible image, the developing device further comprising:

a first detecting block that detects a current flowing in the first power source, a second detecting block that detects a current flowing in the second power source, and an electric field controlling device that controls operation of the second electric field forming device based on the current flowing in the first power source, which is detected by the first detecting block, and the current flowing in the second power source, which is detected by the second detecting block.

2. The developing device according to claim 1, further comprising a load capacity calculating device that calculates a load capacity of the second spatial region based on the current flowing in the first power source, which is detected by the first detecting block, and the current flowing in the second power source, which is detected by the second detecting block, wherein the electric field controlling device controls operation of the second electric field forming device based on the load capacity of the second spatial region, which is calculated by the load capacity calculating device.

3. The developing device according to claim 2, wherein the load capacity calculating device calculates the load capacity of the second spatial region based on the current flowing in the first power source, which is detected by the first detecting block, the current flowing in the second power source, which is detected by the second detecting block, and at least one of an environmental condition for the developing device and an endurance condition of the developing device.

4. The developing device according to claim 1, wherein the electric field controlling device controls operation of the second electric field forming device, and further controls operation of the first electric field forming device to make the first electric field substantially constant.

5. A method for controlling a developing device including a first transporting member that is rotatably driven, and holds, on an outer circumferential surface, a developer containing a toner and a carrier while the developer is transported, a second transporting member that is rotatably driven, and is opposite to the first transporting member to interpose a first spatial region between the members, and is opposite to an electrostatic latent image carrying member to interpose a second spatial region between the second transporting member and the carrying member, a first electric field forming device that includes a first power source connected to the first transporting member and a second power source connected to the second transporting member, forms a first electric field between the first and second transporting members, and shifts the toner in the developer held onto the first transporting member to the second transporting member, and a second electric field forming device that includes the second power source connected to the second transporting member, forms a second electric field between the second transporting member and the electrostatic latent image carrying member, and shifts the toner held onto the second transporting member to an electrostatic latent image of the electrostatic latent image carrying member, thereby converting the electrostatic latent image to a visible image, the method comprising:

detecting a current flowing in the first power source and a current flowing in the second power source, and controlling, based on the detected current flowing in the first power source and the detected current flowing in the second power source, operation of the second electric field forming device.

6. The developing device control method according to claim 5, further comprising: calculating, based on the detected current flowing in the first power source and the detected current flowing in the second power source, a load capacity of the second spatial region, and controlling, based on the calculated load capacity of the second spatial region, operation of the second electric field forming device.

7. The developing device control method according to claim 6, further comprising: calculating the load capacity of the second spatial region based on the detected current flowing in the first power source, the detected current flowing in the second power source, and at least one of an environmental condition for the developing device and an endurance condition of the developing device.

8. The developing device control method according to claim 5, further comprising: controlling operation of the second electric field forming device and operation of the first electric field forming device to make the first electric field substantially constant.

* * * * *